United States Patent [19]

Skinner et al.

[11] Patent Number: 4,508,174

[45] Date of Patent: Apr. 2, 1985

[54] DOWNHOLE TOOL AND METHOD OF USING THE SAME

[75] Inventors: Neal G. Skinner; David S. Wesson, both of Duncan, Okla.

[73] Assignee: Halliburton Company, Duncan, Okla.

[21] Appl. No.: 480,981

[22] Filed: Mar. 31, 1983

[51] Int. Cl.[3] ..... E21B 34/14; E21B 49/00

[52] U.S. Cl. ..... 166/373; 166/178; 166/250; 166/332

[58] Field of Search ..... 166/373, 250, 331, 332, 166/178, 237, 240

[56] References Cited

U.S. PATENT DOCUMENTS

| | | | |
|---|---|---|---|
| Re. 31,313 | 7/1983 | Fredd et al. | 166/332 X |
| 2,907,391 | 10/1959 | Kinley | 166/331 |
| 3,358,771 | 12/1967 | Berryman | 166/331 |
| 4,254,832 | 3/1981 | Patton et al. | 166/332 |
| 4,273,464 | 6/1981 | Scott | 166/240 X |
| 4,278,130 | 7/1981 | Evans et al. | 166/332 |

*Primary Examiner*—James A. Leppink
*Assistant Examiner*—Michael Starinsky
*Attorney, Agent, or Firm*—Joseph A. Walkowski; Thomas R. Weaver

[57] ABSTRACT

A downhole tool includes a pipe string portion which is disposed in a pipe string of a well and a probe portion which can be lowered by wireline or other suitable means into the well for engagement with the pipe string portion. The pipe string portion includes a sliding sleeve valve which is biased in a closed, or unactuated position, by a spring contained within the pipe string portion. The probe portion includes a connector mechanism which engages lugs of the pipe string portion for imparting an opposing force to the sliding sleeve valve which overcomes the biasing force of the spring so that the valve can be opened to permit reservoir pressure to enter a cavity of the probe portion containing a sensor mechanism. The coupling and decoupling of the connector mechanism with the lugs is effected through two downward and two upward movements of the probe portion. The probe portion also includes a jarring mechanism for applying either an upward or a downward force impulse to the probe portion to facilitate its movement should it become stuck, for example.

15 Claims, 7 Drawing Figures

DOWNHOLE TOOL AND METHOD OF USING THE SAME

This invention relates generally to downhole tools which are mechanically actuable and to methods of using the same. This invention relates more particularly, but not by way of limitation, to a wireline tool and method for providing real-time surface readouts of drill stem test data.

In drilling and operating a well, downhole tools are used to monitor downhole conditions, such as temperature and pressure, to obtain information which is helpful in evaluating the nature of the well, such as whether the well is likely to produce. One particular condition which is preferably monitored is reservoir pressure measured over periods of time during which the well is alternately allowed to flow and prevented from flowing. This condition is determined by means of a drill stem test which can be conducted utilizing the Bourdon tube technique known in the art. With this technique a chart having a pressure versus time graph scribed thereon is obtained.

A shortcoming of the Bourdon tube technique is that no real-time or substantially instantaneous readout of the sensed pressure is available at the surface while the pressure is being detected. A real-time readout is needed to permit a person at the well site to quickly know what is occurring downhole during the test periods. This shortcoming exists because to perform a drill stem test using the Bourdon tube technique, a tool containing an unscribed chart and a Bourdon tube instrument are lowered into the well, the well is alternately allowed to flow and prevented from flowing to cause the Bourdon tube instrument to scribe a pressure versus time graph on the chart, and then the tool is withdrawn from the well and the chart analyzed at some relatively considerable time subsequent to the actual time at which the pressures were detected and the chart created.

Another downhole tool known to us is capable of detecting reservoir pressures, such as during a drill stem test, and of providing real-time surface readouts of the pressure. This prior surface readout instrument includes a valve which is contained within a drill or tubing string located in the well. The valve includes a valve member which is moved downwardy into an open position in response to engagement of the valve member with a housing containing a pressure sensor which is connected by wireline to a surface readout device. Initial movement of the housing into the well is effected by lowering it on the wireline; however, further movement of the housing into engagement with the valve member, and subsequent opening of the valve, is achieved by operation of an electrical, motorized actuator sub of a type known to the art. The actuator sub engages the housing in the well and moves it farther down into the well into engagement with the valve member and on downward until the valve is opened, thereby communicating the reservoir pressure to the pressure sensor.

A tester valve with which this prior surface readout instrument is associated is periodically opened and closed to perform a drill stem test in a manner as known to the art. During the drill stem test, the pressures are detected through the open valve and electrically communicated to the surface via the wireline. When the test has been completed, the actuator sub moves the housing upward in response to electrical commands from the surface. Once the actuator sub has fully disengaged the housing from the valve, the housing and actuator sub assembly are pulled out of the well by reeling in the wireline.

One disadvantage of this prior art surface readout instrument is that it requires electrical power to operate the motor of the actuator sub to engage and disengage the housing (and associated pressure sensor) and the valve member. If the motor fails to operate or if electrical continuity to the motor is lost or if the wireline or cable head develops a short-circuit, for example, the housing and valve member cannot be engaged or disengaged. Such electrical problems are rather frequent because of the extreme downhole environments which are encountered in a well and the relatively long periods of time (days, sometimes) during which the instrument is kept in the well.

Another shortcoming of this prior surface readout instrument is that the actuator sub is a complex tool which is difficult to manufacture and difficult to maintain in the field. It is also a relatively expensive tool.

Still another shortcoming of the prior art surface readout instrument is that it is relatively long, being almost seventeen feet long in one embodiment of which we are aware.

Another type of downhole tool by means of which downhole pressures can be detected and their magnitudes communicated to the surface includes a pressure sensing probe installed in a section of pipe of a pipe string which is to be disposed in the well. This probe is exposed to the borehole environment when the pipe string is in the well, and thus it must be durably constructed to endure the extremes found therein. The magnitude of the pressure detected by this type of probe is communicated to the surface via a connector tool which couples with the probe. The connector tool can be relatively easily removed from the well if a problem occurs; however, if the probe malfunctions or otherwise needs to be removed, the entire pipe string must be removed. This is a significant disadvantage because of the time and expense of tripping the pipe string out of and back into the well.

Therefore, in view of the disadvantages of the aforementioned prior art devices of which we are aware, there is the need for an improved downhole tool and an improved method for using the tool. In particular, such an improved tool should be able to sense reservoir pressure which is to be monitored during a drill stem test, for example, and to communicate the magnitude of the sensed pressure to the surface for providing a real-time readout of the pressure magnitude.

Such a tool should be constructed so that it can be installed and removed with downhole mechanical means, rather than downhole electrical means, to obviate the necessity of an actuator sub and the related electrical circuitry which is subject to the aforementioned problems. To assist in the mechanical manipulation of such a tool, there should also be included means for jarring, or applying force impulses, to the tool to assist in the mechanical coupling and decoupling of the tool elements.

Such a tool should also include a housing for protectively containing a sensor, which housing and sensor can be removed from the well without removing the pipe string in which the tool is to be used.

Such an apparatus should also be constructed to be relatively compact to enhance the transportability of the tool to the well site and the handling of the tool at the well site.

The present invention overcomes the above-noted and other shortcomings of the prior art by providing a novel and improved downhole tool and method of using the same. The present invention is constructed to be utilized without the need of any downhole electrical controls in placing the tool in an operating position in a well, in removing it therefrom, or in mechanically opening and closing a valve of the tool. The invention also includes jarring means for assisting in the mechanical implacement and extraction of the tool. The present invention is also constructed so that it has a size which makes it relatively easy to transport and handle. The preferred embodiment tool is particularly constructed to sense reservoir pressures and provide electrical signals to the surface for generating real-time readouts of the pressure magnitudes. The tool includes a relatively easily removable protective housing for containing a sensor which senses the desired downhole condition.

Broadly, the present invention provides a downhole tool for use in a well. The downhole tool includes support means for supporting the tool in the well, slide means disposed in sliding relationship with the support means, biasing means for biasing the slide means toward a tool-unactuated position, and mechanical means, responsive to a longitudinal reciprocation resulting in a counterforce opposing a biasing force of the biasing means, for moving the slide means from the tool-unactuated position to a tool-actuated position when the counterforce is greater than the biasing force.

The mechanical means includes a housing and a connector means rotatably disposed on the housing for engaging protuberances on the slide means. The engagement of the connector means with the protuberances occurs in response to the longitudinal reciprocation.

The mechanical means further includes jarring means for providing a force impulse to the housing.

The method of the present invention broadly includes lowering the mechanical means into the well on a cable whose movement is controlled by a suitable hoist means located at the surface of the well. The mechanical means is lowered into the well until the connector means suitably engages the protuberances of the slide means. The cable is then withdrawn from the well to raise the housing so that the connector means locks with the protuberances whereby further lifting of the housing moves the slide means upward against the biasing means to the tool-actuated position. Once the tool has performed its function in the tool-actuated position, the cable is lowered so that the housing descends into the well whereby the connector means unlocks from the protuberances. The cable is then raised so that the housing is lifted out of the well. To assist in the engagement or removal of the connector means and the protuberances, the cable can be raised a short distance to activate the jarring means and then released to allow the jarring means to slam into the housing with a force impulse. The tool can also be used so that the force impulse is applied by a quick upward movement of, rather than a release of, the cable.

Therefore, from the foregoing, it is a general object of the present invention to provide a novel and improved downhole tool and method of using the same. Other and further objects, features and advantages of the present invention will be readily apparent to those skilled in the art when the following description of the preferred embodiment is read in conjunction with the accompanying drawings.

FIGS. 1A–1E form a partially sectioned elevational view of a downhole tool constructed in accordance with a preferred embodiment of the present invention.

Figure 1A:
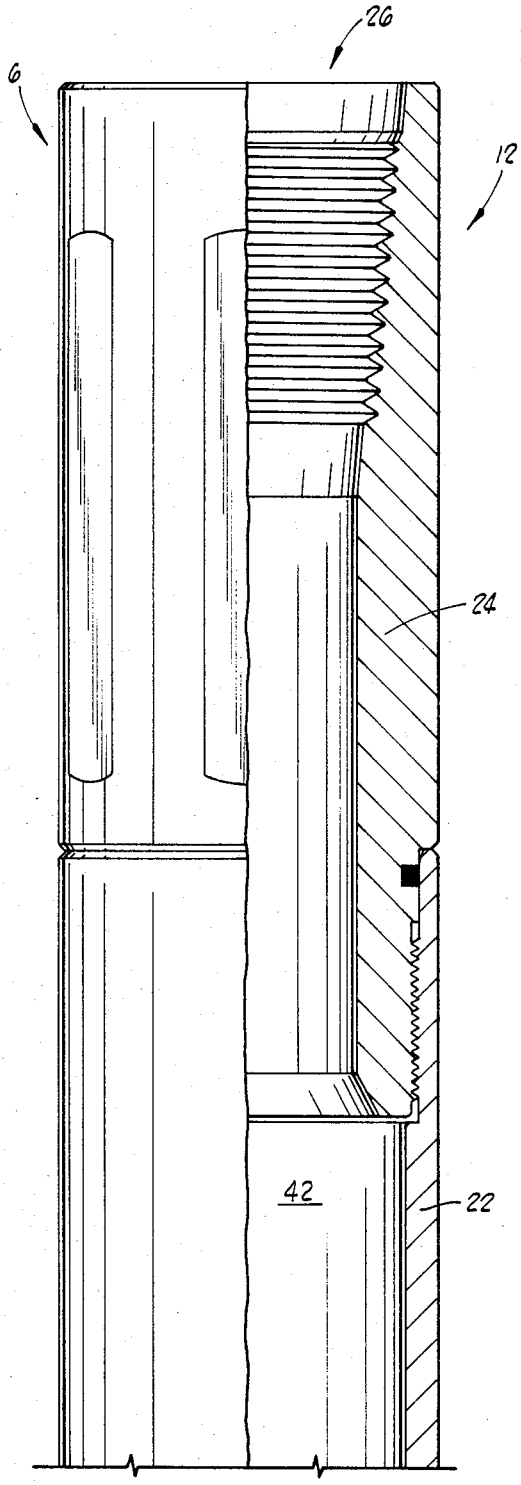

With reference to the drawings, a tool constructed in accordance with a preferred embodiment of the present invention will be described. As illustrated in FIG. 3, the tool includes a pipe string portion 2 and a probe portion 4. The preferred embodiment of these two portions will be described with reference to FIGS. 1A–2.

The pipe string portion 2 is shown in FIGS. 1A–1E to broadly include support means 6 for supporting the tool in a well, slide means 8 (FIGS. 1C–1D) disposed in sliding relationship with the support means 6, and biasing means 10 (FIG. 1C) for biasing the slide means 8 toward a tool-unactuated position, which tool-unactuated position of the preferred embodiment is that position in which the slide means 8 is shown in the drawings. The support means 6 has a top end 12 (FIG. 1A) and a bottom end 14 (FIG. 1E), which top end 12 is disposed closer than the bottom end to the top of the well when the support means 6 is disposed in the well. In the preferred embodiment, the slide means 8 is supported by the support means 6 at a position which is closer to the bottom end 14 than is the position at which the biasing means 10 is retained in the suppport means 6.

It is to be noted that as used herein, the words "top," "upward" and the like define positions or directions of elements which are relatively higher, as viewed in the drawings hereof or with reference to the top or mouth of the well, than are associated elements identified as "bottom," "downward" and the like.

In the preferred embodiment the support means 6 is a substantially cylindrical structure comprising several elements as illustrated in the drawings. These elements are arranged in an outer structure and an inner structure. The outer structure functions as a container means for holding the inner structure and for holding the pressure, and it also functions as the means by which the tool is connected into a pipe or tubing string or other structure by means of which the pipe string portion 2 is retained in the well. It is to be noted that as used in the specification and claims hereof, "pipe string" is to mean that structure by which the pipe string portion 2 is held in the well, whether that structure is actually known in the art as a pipe string, a drill string, a tubing string, or other type of structure.

Figure 1B:
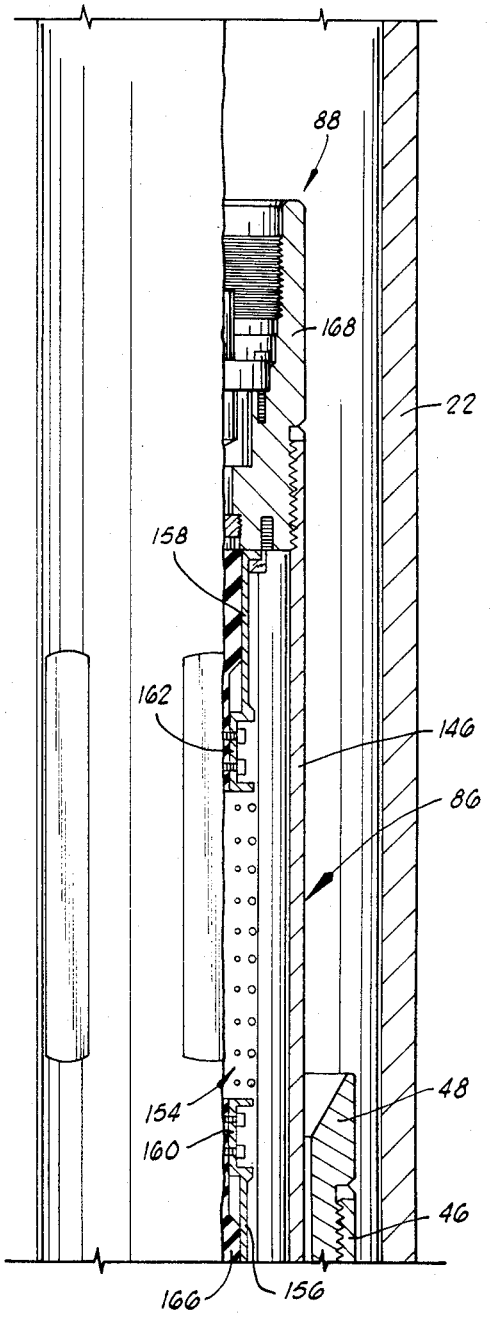
Figure 1C:
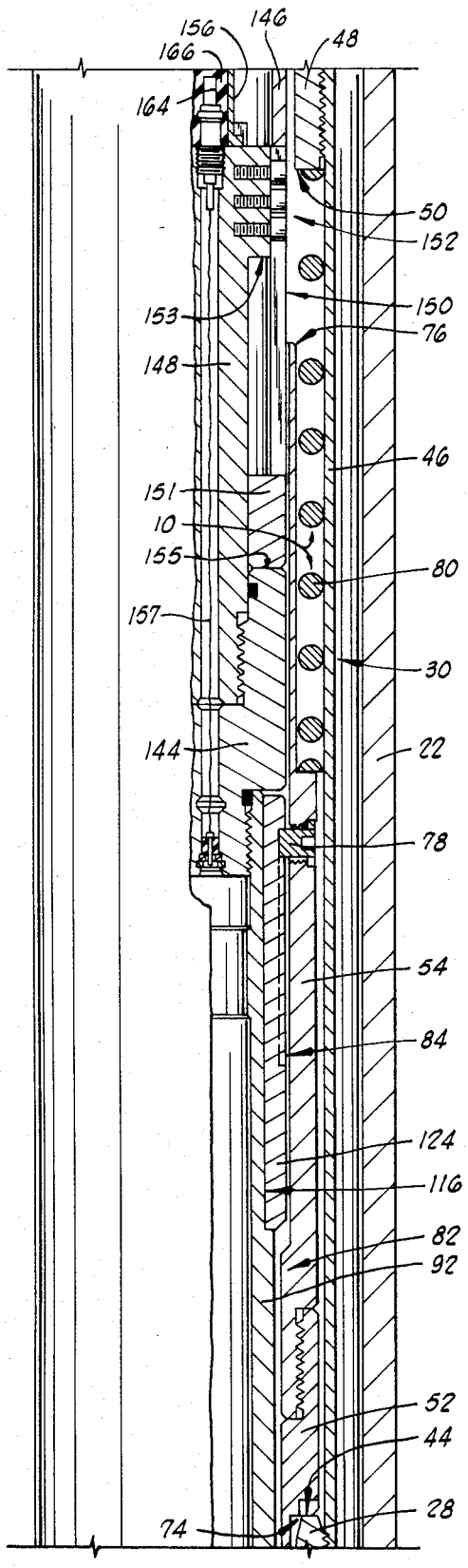
Figure 1D:
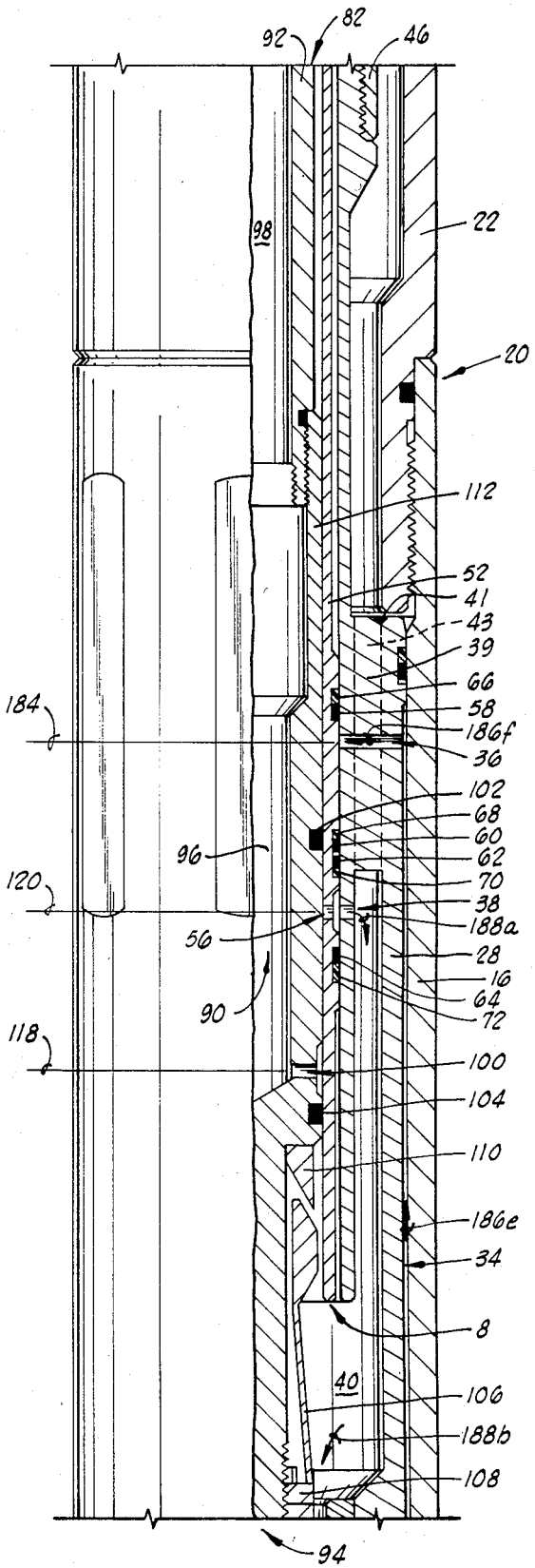

The outer structure, or container means, includes in the preferred embodiment a cylindrical valve case 16 having a bottom end 18 and a top end 20. The bottom end 18 is connectible with a tested valve as will be subsequently described. The top end 20 is shown in FIG. 1D to be threadedly and fluid-tightly connected to a first end of a housing case 22 forming another part of the container means. The housing case 22 includes a second end which is shown in FIG. 1A to be threadedly and fluid-tightly connected to a top adapter member 24 having a threaded box end 26 for coupling with a threaded pin end of a pipe (not shown).

Figure 1E:
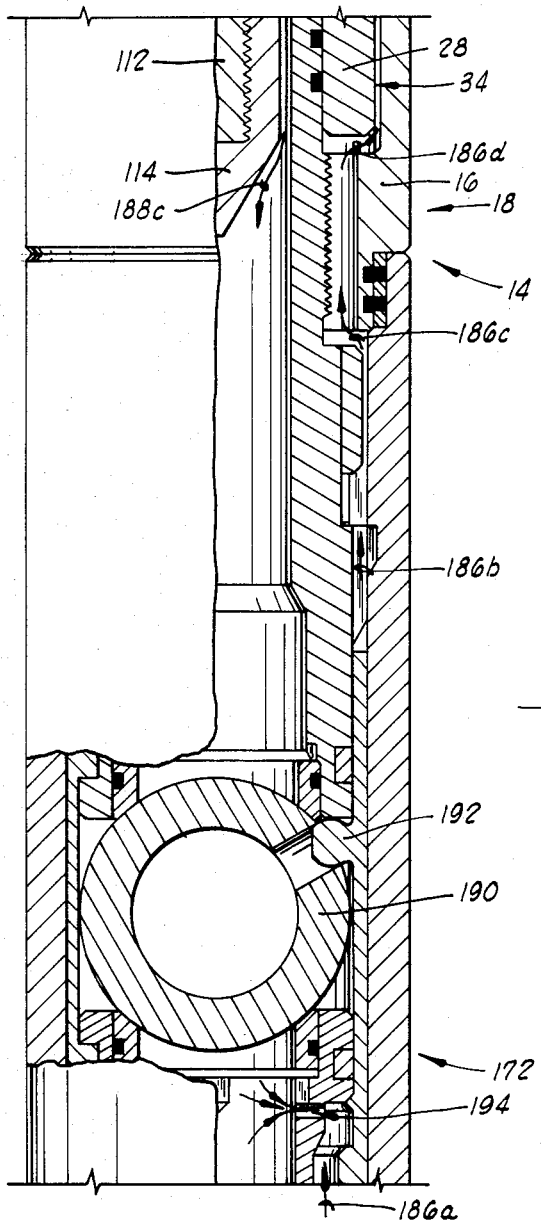

The inner structure which is contained with the outer structure includes a valve body 28 and retainer means 30 for retaining the biasing means 10. The valve body 28 is shown in FIGS. 1C–1E, and the retainer means 30 is shown in FIGS. 1B–1D.

The valve body 28 has a relief area 34 defining a space between the valve case 16 and the valve body 28. Reservoir or well fluid, and thus reservoir or well pressure, is always present in the region defined by the relief area 34 when the pipe string portion 2 is disposed in the well. The region defined by the relief area 34 communicates with at least one port or opening 36 defined laterally through the valve body 28 whereby the reservoir or well pressure is also present in the port 36.

The valve body 28 includes another port 38 which communicates with a cavity 40 defined in the valve body 28 as shown in FIG. 1D. The cavity 40 opens into a hollow interior portion 42 of the pipe string portion 2.

The valve body 28 also includes spiders 39 welded, as at a weld 41, into the main portion of the valve 28. The spiders 39 are spaced from each other so that openings 43 are defined therebetween. These openings 43 permit borehole fluid to flow to the surface along the passageway shown in FIGS. 1B–1D to be defined between the housing case 22 and the retainer means 30, through the adapter member 24, and through the pipe string in which the pipe string portion 2 is disposed.

The valve body 28 further includes stop means for defining a first limit of travel which limits the distance the slide means 8 can move in the downward direction. In the preferred embodiment the stop means includes a shoulder 44 defined at the top of the valve body 28. The shoulder 44 extends inwardly of the retainer means 30 which is connected to the valve body 28. "Inwardly" and the like refer to a direction or position relatively closer to the longitudinal axis of the tool.

The retainer means 30 includes in the preferred embodiment an elongated member 46 having the biasing means 10 retained therein for engagement with the slide means 8. The retainer means 30 also includes a cap 48 threadedly connected to the top end of the elongated member 46. The cap 48 provides a shoulder 50 which functions as a stop means for defining a limit of travel of the slide means 8 in the upward direction. The cap 48 also defines a barrier against which an upwardly acting force acts in opposition to the biasing force provided by the biasing means 10.

As shown in FIGS. 1C–1E, the valve body 28 is primarily disposed within the valve case 16 so that there is little if any relative movement between the valve case 16 and the valve body 28 in a longitudinal direction. FIGS. 1B–1D disclose that the retainer means 30 is disposed within the housing case 22. These elements are substantially cylindrical with hollow interiors in which the slide means 8 and the biasing means 10 are disposed.

As shown in FIGS. 1C–1D, the slide means 8 of the preferred embodiment includes a sliding sleeve valve comprising a valve member 52 and an extension member 54. The valve member 52 is slidable adjacent the valve body 28, and the extension member 54 is slidable, simultaneously with the valve member 52, adjacent the elongated member 46.

The valve member 52 has at least one port 56 defined therethrough. The valve member 52 is disposed within the pipe string portion 2 so that the port 56 can be positioned along the valve body 28 between a position at which the port 56 is substantially aligned in fluid communication with the port 36 and a position spaced from a port 36, which position in the preferred embodiment is the location of a port 38. To maintain the port 56 fluid-tightly sealed with whichever of the ports 36 or 38 it is in fluid communication, and to fluid-tightly seal the port 56 from the other of such ports 36 or 38 with which it is not then in fluid communication, the valve member 52 has O-rings 58, 60, 62, 64 and Teflon backup rings 66, 68, 70 and 72 associated therewith as shown in FIG. 1D.

To properly position the valve member 52 and the port 56 relative to the ports 36 and 38, the valve member 52 further includes means for cooperating with the stop means defined in a preferred embodiment by the shoulder 44 and means for cooperating with the other stop means defined by the shoulder 50. The means for cooperating with the shoulder 44 is defined in the preferred embodiment by a shoulder 74 which is an outwardly extending flange that engages the shoulder 44 to limit the downward movement of the valve member 52 in response to the biasing force exerted by the biasing means 10. The stop means which cooperates with the shoulder 50 is defined by another shoulder 76 defined by an upper end of the extension member 54. The shoulder 76 engages the shoulder 50 to limit the upward movement of the valve member 52 in response to an opposing force oppositely directed to and greater than, the force exerted by the biasing means 10. In the preferred embodiment, when the shoulder 74 engages the shoulder 44, the ports 38 and 56 are in fluid communication, and when the shoulder 76 engages the shoulder 50, the ports 36 and 56 are in fluid communication.

The extension member 54 provides a biasing means engagement arm for engaging and compressing the biasing means 10 when a sufficient opposing force is applied to the sliding sleeve valve. The extension member 54 also responds to a superior biasing force to move the valve member 52 to its lowermost position wherein the ports 38 and 56 are in fluid communication.

Associated with the extension member 54 of the preferred embodiment is at least one pin 78 which is shown in FIG. 1C to be threadedly connected in an opening defined through the extension member 54. The pin 78 is inwardly directed so that it protrudes as an engagement lug into the hollow interior portion 42 of the pipe string portion 2. This protruding lug engages the probe portion 4, as will be subsequently described, so that the aforementioned opposing force can be transmitted to the sliding sleeve valve to overcome the biasing force provided by the biasing means 10.

As shown in FIG. 1C, the biasing means 10 of the preferred embodiment includes a spring 80 retained within the retainer means 30 (alternatively denominated a "spring housing" for the preferred embodiment) between the cap 48 and the extension member 54. The spring 80 exerts the aforementioned biasing force against the extension member 54 tending to urge the shoulder 74 into engagement with the shoulder 44. It is this biasing force of the spring 80 which a counterforce applied to the probe portion 4 in engagement with the pin 78 must overcome to move the slide means 8 to a tool-actuated position wherein, for the preferred embodiment, the port 56 is moved into fluid communication with the port 36.

The probe portion 4 includes mechanical means for moving the slide means 8 from the tool-unactuated position (i.e., the position in which the ports 38 and 56 are in fluid communication in the preferred embodiment) to the tool-actuated position (i.e., the position in which the ports 36 and 56 are in fluid communication in the preferred embodiment) when the aforementioned counterforce, which counterforce is provided in the preferred embodiment by a longitudinal reciprocation of the probe portion 4, is greater than the biasing force exerted by the biasing means 10. The mechanical means of the preferred embodiment includes housing means 82 (FIGS. 1C–1E), connector means 84 (FIG. 1C), jarring means 86 (FIGS. 1B–1C) and coupling means 88 (FIG. 1B).

The housing means 82 is used for receiving a pressure sensor device (not shown). In the preferred embodiment, the pressure sensor device is received in a cavity 90 defined within a gauge housing 92 and a nose assembly 94 threadedly and fluid-tightly connected to the gauge housing 92 as shown in FIG. 1D. The cavity 90 includes a portion 96 in which a probe of the pressure sensor device is positioned and a portion 98 defined within the gauge housing 92 in which the electrical circuitry for the pressure sensor device is located. In the preferred embodiment, the pressure sensor device is a Geophysical Research Corporation 512H pressure and temperature gauge which is relatively small so that the preferred embodiment of the mechanical means is relatively compact; however, other instruments can also be used. For example, multi-channel devices, sensor devices having memory for retaining the detected information downhole until the probe portion 4 is extracted from the well, as well as other devices, can be used. It is to be noted that the mechanical means is also made relatively compact because it does not include an actuator sub.

Pressure is communicated to the pressure sensor probe disposed within the cavity portion 96 of the nose assembly 94 via at least one port 100 defined through the wall of the nose assembly 94. The port 100 is maintained on fluid communication with the port 56, but is fluid-tightly sealed from other portions of the tool by means of O-rings 102, 104.

The nose assembly 94 has a plurality of guide fingers 106 pivotally associated therewith for preventing abrasion of O-rings 102 and 104 by contact with the interior of the pipe string. The fingers 106 are biased to pivot in a direction away from the probe portion 4 by suitable biasing means located at the points of connection between the fingers 106 and the nose assembly 94, one of which points of connection is identified in FIG. 1D by the reference numeral 108. To prevent the fingers 106 from extending outwardly an undesirable distance, a retaining ring 110 is provided on the nose assembly 94.

As shown in FIGS. 1D–1E, the nose assembly 94 includes a main body 112 having a conical tip 114 threadedly connected thereto.

The gauge housing 92 includes a substantially cylindrical sleeve element having a recessed region 116 on which the connector means 84 is rotatably disposed in the preferred embodiment. The connector means 84 engages the protruding lug or lugs provided by the one or more pins 78 (subsequently referred to in the singular for convenience) when the probe portion 4 is longitudinally moved into the hollow interior portion 42 of the pipe string portion 2. When this engagement is suitably secured with the protruding lug and the connector means related in a locked position, the sliding sleeve valve can be moved in opposition to the biasing means 10. This locking position is achieved in the preferred embodiment when the probe portion 4 is disposed within the pipe string portion 2 and the ports 56 and 100 are substantially spatially aligned.

Stated differently, the connector means 84 is mounted on the gauge housing 92 for cooperative engagement with the pin 78 for defining a first position and a second position to which the housing means 82 is movable relative to the sliding sleeve valve. The first position is the lowermost position to which the housing means 82 can move relative to the sliding sleeve valve. The second position is the uppermost engaged position to which the housing means 82 can move relative to the sliding sleeve valve when the connector means 84 and the pin 78 are engaged. This second position is also the position of the housing means 82 from which movement of the sliding sleeve valve commences when the aforementioned opposing force greater than the biasing force exerted by the biasing means 10 is applied to the probe portion 4. In the preferred embodiment, the ports 56 and 100 are spaced from each other as shown in FIG. 1D when the housing means 82 is in the first position, and the ports 56 and 100 are substantially spatially aligned when the housing means 82 is in the second position. In the preferred embodiment, the reference numeral 118 identifies the location of the port 100 in the first position, and the reference numeral 120 identifies the location of the port 100 in the second position. Although having different spatial relationships between the first and second positions, the ports 56 and 100 are always in fluid communication in each of these positions as is apparent from the ilustrated spacing of the O-rings 102, 104.

Figure 2:
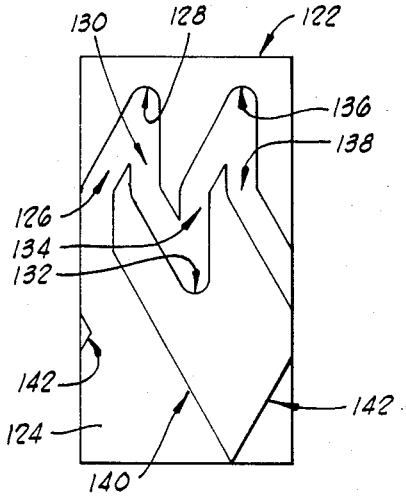
FIG. 2 is a layout view of a J-slot member of the preferred embodiment shown in FIG. 1C.
Figure 3:
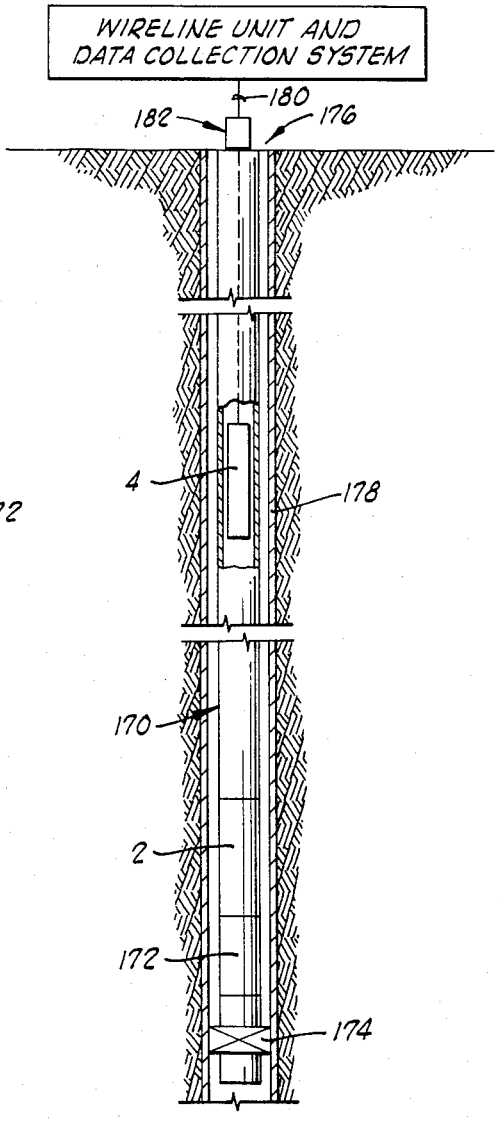
FIG. 3 is a schematic representation of the present invention associated with a pipe string disposed in a well.

With reference to FIG. 2, the preferred embodiment of the connector means 84 will be described. The connector means 84 of the preferred embodiment includes a J-slot member 122 having a collar 124 rotatably mounted on the gauge housing 92 and further having channel means defined in the collar 124. The channel means cooperate with pin 78 so that the positions 118 and 120 are defined and further so that the valve member 52 is moved between the limits of travel defined by the shoulders 44, 74 and 50, 76.

The channel means includes a first channel 126 for receiving and engaging the pin 78 when the probe portion 4 is moved into the pipe string portion 2 a sufficient distance to place the port 100 at the position 118. This distance into which the probe portion 4 can be advanced toward the bottom end of the pipe string portion 2 is limited by an upper wall 128 of the first channel 126.

The channel means also includes a second channel 130 into which the pin 78 moves after it has engaged the wall 128. The second channel 130 receives and engages the pin 78 when the probe portion 4 is moved a distance away from the bottom end of the pipe string portion 2 after having first been moved so that the pin 78 engages the wall 128. The extent to which the probe portion 4 can move relative to the pipe string portion 2 when the pin 78 is in the second channel 130 is limited by a wall portion 132 of the channel 130. When the pin 78 is engaging the wall portion 132, the probe portion 4 is in the locked position relative to the pipe string portion 2. When the probe portion 4 and the pipe string portion 2 are in this locked relationship, the port 100 is at the second position 120 wherein it is substantially spatially aligned with the port 38. From this position, the probe portion 4 can be pulled away farther from the bottom end of the pipe string portion 2 if the pulling force is sufficiently strong to overcome the biasing force of the spring 80; if this occurs, then both the probe portion 4 and the slide means 8 move relative to the support means 6 of the pipe string portion 2. This causes the substantially aligned ports 56 and 100 to be moved, in unison, into fluid communication (and, in the preferred embodiment, into substantial spatial alignment) with the port 36 so that the fluid pressure present in the port 36 is communicated to the pressure sensor probe contained in the cavity portion 96 of the nose assembly 94.

The channel means of the J-slot member 122 further includes a third channel 134 for receiving and engaging the pin 78 when the probe portion 4 is again moved toward the bottom end of the pipe string portion 2 after having been moved to position the pin 78 in the locked position adjacent the wall portion 132. The movement of the pin 78 through the third channel 134 continues until the pin 78 engages a wall portion 136 of the channel 134. When the pin 78 is at the position adjacent the wall portion 136, the port 100 has returned to the position 118 so that the pressure sensor probe is no longer in fluid communication with the well pressure present in the port 36. During this movement of the pin 78 from the locked position adjacent the wall portion 132 to the wall portion 136, the fluid communication with the port 36 has been broken, the pressure within the cavity 90 has been vented through the ports 100, 56 and 38 and the cavity 40, and the ports 56 and 100 have again become spatially separated.

The channel means also includes a fourth channel 138 for receiving and disengaging the pin 78 when the probe portion 4 is moved away from the bottom end of the pipe string portion 2 after having been moved the aforementioned directions by means of which the pin 78 has traveled through the first, second and third channels.

The channel means also includes lower wall portions 140, 142 which are constructed to direct the pin 78 into the first channel 126 when the probe portion 4 is initially lowered into the pipe string portion 2.

The wall portions 128, 132 and 136 function as lug engagement limiting means for limiting the travel of the lug 78 through the channel means.

It is to be noted that in the preferred embodiment the connector means 84 includes two sections of the collar and channel means shown in FIG. 2 (i.e., FIG. 2 is a layout view of one-half, or 180°, of the preferred embodiment connector means 84). Each of the two sections cooperates with its own respective pin 78 so that the illustrated preferred embodiment includes two pins 78. It is to be further noted, however, that the present invention does not require that two of each of these structures be used; that is, more or less than two can be used.

The connector means 84 is associated with the top portion of the gauge housing 92 near a threaded end which is connected to the jarring means 86 by a suitable coupling member 144. The jarring means 86 includes a jar case 146 and a jar mandrel 148, connected to the gauge housing 92 through threaded engagement with the coupling member 144, for retaining the jar case 146 in sliding relationship with the housing means 82. The jar case 146 includes a slot 150 through which the heads of a plurality of screws 152 extend from the jar mandrel 148 for permitting the sliding relationship, but for preventing circumferential or torsional movement of the jar case 146 relative to the jar mandrel 148 and housing means 82.

The jar case 146 includes a striker block portion 151 located at the lower end of the slot 150. The striker block 151 is movable, as will be subsequently described, between an upper flange 153 of the jar mandrel means and a lower flange 155 of the jar mandrel means, which lower flange 155 is specifically established by the upper edge of the coupling member 144.

The jar case 146 is a substantially cylindrical, hollow member having electrical connectors disposed therein for providing electrical continuity between the electrical circuitry of the pressure sensor device located in the housing means 82 and a wireline connected to the probe portion 4. In the preferred embodiment shown in FIG. 1B, the electrical continuity is provided by insulated electrically conductive springs 154. The springs 154 are disposed so that their spirals are oppositely directed to prevent the springs 154 from becoming meshed. One of the springs connects the wireline with an electrical conductor 157 (FIG. 1C) connected to the electrical circuitry of the pressure sensor device, and the other spring provides ground continuity with the electrically conductive metal of which the elements of the present invention are constructed. To secure insulated electrical conductors extending from the springs 154 against movements of the jarring means 86, the jar case 146 has standoff members 156, 158 suitably retained therein for applying a pressure to the insulated conductors running under feet 160, 162 thereof. The electrical conductor extending under the foot 160 is electrically connected with a pin 164 (FIG. 1B) which is subsequently electrically connected, by suitable means known to the art, to the electrical circuitry of the pressure sensor device. A rubber boot 166 is disposed around the electrical conductor and pin 164 within the standoff element 156. As shown in the drawings, a similar construction is used with respect to the standoff member 158.

Through the standoff member 158, electrical continuity is provided to the coupling means 88, which in the preferred embodiment is a top coupling member 168 suitably constructed for receiving an electrical adapter, sinker bars and cable head through which the wireline is connected to the probe portion 4 as known to the art.

With reference to FIG. 3, a use of the preferred embodiment of the present invention will be described. Initially, the pipe string portion 2 is made up as a part of a pipe string 170 (which, as previously described, can be a tubing string or other structure which is identified herein under the name "pipe string"). Also forming portions of the pipe string 170 are a tester valve 172 and a packer 174. The tester valve 172 is of any suitable type as known to the art, such as a Halliburton Services APR ®-N tester valve for use in a cased hole or a FUL-FLO ® HYDROSPRING tester valve for use in an open hole. The packer 174 is also of a suitable type as known to the art, such as a Halliburton Services RTTS hook wall packer or open hole testing packer.

In the preferred embodiment shown in FIG. 1E, the tester valve 172 includes a ball valve member 190 actuated by valve actuator arms 192 as known to the art. The tester valve 172 also includes a port 194 for communicating reservoir fluid and pressure to the pipe string portion 2 even when the ball valve member 190 is closed.

The pipe string 170 in FIG. 3 is disposed in a well 176 having a casing 178 disposed therein by way of example and not by way of limitation, as the present invention can be employed in an open hole. The packer 174 is set as known to the art. With this installation completed, the probe portion 4 of the present invention can be lowered into the pipe string 170 for engagement with the pipe string portion 2 of the present invention so that drill stem tests, for example, can be conducted.

The probe portion 4 is moved into and out of the wall 176 on a wireline cable 180 which is part of a wireline unit of a type as known to the art. Movement of the wireline cable 180 is by suitable hoist means included in the wireline unit as known to the art.

Associated with the wireline unit, as shown in FIG. 3, is a data collection system of a type as known to the art for retrieving and processing the electrical information received from the probe portion 4 via the wireline cable 180. In an embodiment of a suitable data collection system known to the art, pressure versus time plots can be developed and the well's productivity, static reservoir pressure, transmissibility, actual flow capacity, permeability, and formation damage can be calculated, plotted and printed at the well site. The data collection system also includes means for displaying the real-time pressure readings taken by the preferred embodiment of the present invention.

For this utilization schematically illustrated in FIG. 3, the probe unit 4 is placed into the well 176 through pressure control equipment 182 of a type as known to the art. The pressure control equipment 182 includes a pressure control unit, a wireline blowout preventor valve, and a lubricator stack of types as known to the art. The pressure control unit provides hydraulic pressure to the wireline blowout preventor valve, the lubricator stack and the wireline unit. The pressure control unit also supplies grease, injected under pressure, methanol injection and a pneumatic supply to the lubricator stack.

The wireline blowout preventor valve is used in conjunction with the lubricator stack when operations under pressure are to be performed. This valve is hydraulically operated and controlled by the pressure control unit.

The lubricator stack provides a means for installing the probe portion 4 in preparation of its running into the well while the well 176 is under pressure. With the probe portion 4 so installed, the wellhead valve is opened to allow its entry into the wellbore as known to the art.

With reference to all the drawings, a more particular description of the method of using the present invention will be provided.

The method of the preferred embodiment includes the steps of disposing the pipe string portion 2 into the well 176 so that the valve means of the pipe string portion 2 is located downhole in association with the tester valve 172.

The probe portion 4 is connected with the wireline cable 180 and inserted into the well 176 through the pressure control equipment 182. The hoist means of the wireline unit is actuated to unreel the wireline cable 180, thereby lowering the probe portion 4 into the well toward the pipe string portion 2. This lowering is continued until the pin 78 is guided by either the wall portion 140 or the wall portion 142 into the first channel 126 and into engagement with the wall portion 128. At this position, the ports 36, 38, 56 and 100 are disposed as shown in FIG. 1D. In this position, the probe portion 4 is unable to be lowered any farther into the well 176.

Next, the hoist means is actuated to reel in the wireline cable 180 so that the probe portion 4 is moved upwardly relative to the pipe string portion 2. This movement causes the pin 78 to travel through the second channel 130 into the locked position adjacent the wall portion 132. Once this step has been performed, the port 100 has come into substantial spatial alignment with the port 56 or, in other words, has moved to the position 120.

With the pin 78 locked against the wall portion 132, the hoist means is further actuated to tension the wireline cable 180 with a force which is greater than the biasing force exerted by the spring 80. In the preferred embodiment, this force is approximately 600 pounds. When this force is applied by the hoist means to the wireline 180, the probe portion 4 continues to be lifted and the wall portion 132 acts against the pin 78 to move the sliding sleeve valve upward against the spring 80. This upward movement can be continued until the shoulder 76 engages the shoulder 50. When the shoulder 76 engages the shoulder 50, the ports 56 and 100, which ports have been maintained in substantial spatial alignment through the locking engagement of the pin 78 and the wall portion 132, are moved into substantial spatial alignment and, more generally, fluid communication with the port 36. This positioning is indicated by the line in FIG. 1D identified with the reference numeral 184. In this position, the fluid pressure which is present in the port 36 is communicated to the cavity 90 whereby the well pressure is sensed by the pressure sensor device located in the housing means 82. That the pressure from the well is present in the port 36 is indicated by the pressure and fluid flow path identified by the arrows labeled with the reference numerals **186*a*–186*f***.

With the ports 36, 56 and 100 at the position 184, the tester valve 172 is actuated several times to perform a drill stem test as known in the art. The pressures resulting from the drill stem test are detected by the pressure sensor device contained in the probe portion 4. The detected pressures are converted into corresponding electrical signals which are transmitted to the surface over the wireline cable 180. Although in the preferred embodiment the electrical signals are communicated to the surface for providing a real-time surface readout via the data collection system, the present invention is contemplated for use with a slick line and detector devices which have self-contained electrical power sources and memories for retaining data corresponding to the detected pressures, temperatures and other parameters until after the probe unit 4 is extracted from the well. Furthermore, the broad aspects of the present invention can also be used with other devices, both electrical and non-electrical, which may detect parameters other than pressure in a downhole environment.

Once the testing has been conducted with the illustrated preferred embodiment, the tester valve 172 is closed and the tension is released from the wireline cable 180 so that the probe unit 4 is lowered relative to the pipe string portion 2. This lowering continues until the pin 78 engages the wall portion 136 of the third channel of the connector means 84. When this engagement occurs, the ports 56 and 100 are returned to their positions as shown in FIG. 1D. As the pin 78 moves through the third channel 134 toward the wall portion 136 and the ports 56 and 100 return to their positions as shown in FIG. 1D, the pressure from the cavity 90 of the housing means 82 is vented through the ports 38, 56 and 100 which are maintained in fluid communication. This pressure venting occurs along the path identified by the arrows labeled with the reference numerals **188*a*–188*c*. This pressure relieving operation is important because it relieves the pressure on the O-rings 102 and 104 so that the probe portion 4** can be more easily removed from the well.

Once the pin 78 has moved to its position adjacent the wall portion 136 and the pressure has been relieved from the O-rings 102 and 104, the hoist means is actuated to reel in the wireline cable 180 so that the probe unit 4 is withdrawn from its association with the pipe string portion 2 and the well 176. This disengagement is initiated with the relative movement of the pin 78 along the fourth channel 138 of the connector means 84.

The coupling and decoupling of the connector means 84 and the pin 78 generally achieved by the longitudinal reciprocating movement of the wireline cable 180 can be facilitated by using the jarring means 86. If the coupling between the connector means 84 and the pin 78 is stuck and the probe portion 4 needs to be moved down into the well farther, the wireline cable 180 can be withdrawn so that the jar case 146 is positioned with the striker block 151 adjacent the upper flange 153 of the jar mandrel 148. With the striker block 151 so positioned, the wireline cable 180 can be released so that the striker block 151 and portions connected thereto move rapidly downwardly to apply a force impulse to the lower flange 155 of the jar mandrel means. If the connection between the connector means 84 and the pin 78 is stuck and the probe portion 4 needs to be moved in an upward direction, the aforementioned procedure can be reversed wherein the striker block 151 is positioned adjacent the flange 155 as shown in FIG. 1A and then moved rapidly upwardly by rapid intake of the wireline cable 180 on the hoist means so that the striker block 151 applies a force impulse to the upper flange 153 of the jar mandrel 148.

From the foregoing it is apparent that the present invention provides a downhole tool which is mechanically actuated and deactuated without the need for any downhole electrical equipment. This purely mechanical operation can be assisted by the described jarring means if necessary or desired. In the preferred embodiment, downhole conditions can be sensed and provided to the surface for real-time display utilizing a condition sensor device which is protectively housed from the borehole environment and which can be relatively easily transported into and out of the well without moving an entire pipe string. Furthermore, the present invention provides for a relatively compact structure which enhances its transportability and handling.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A tool for sensing, with a sensor device, a condition in a well having a fluid, said tool comprising:

a slidable valve member having a first port defined therein;

an inwardly directed member associated with said valve member;

biasing means for exerting a biasing force on said valve member;

support means having a top end and a bottom end, for supporting said valve member and said biasing means, said support means including a second port for receiving said fluid from said well;

housing means having a cavity defined therein for receiving said sensor device and further having a third port defined therein in communication with said cavity; and connector means, disposed on said housing, for engaging and moving said valve member relative to said second port when said housing is disposed within said support means, said first and third ports are in fluid communication, and an opposing force greater than said biasing force is applied to said housing in opposition to said biasing force, said connector means including a collar rotatably mounted on said housing means, said collar having defined therein:

first channel means for receiving and engaging said inwardly directed member when said housing means is moved a first distance into said support means toward said bottom end;

second channel means for receiving and engaging said inwardly directed member when said housing means is moved a second distance away from said bottom end, after having been moved said first distance;

third channel means for receiving and engaging said inwardly directed member when said housing means is moved a third distance, toward said bottom end, after having been moved said first and second distances; and fourth channel means for receiving and disengaging said inwardly directed member when said housing means is moved a fourth distance, away from said bottom end, after having been moved said first, second, and third distances.

2. An apparatus as defined in claim 1, further comprising jarring means for providing a force impulse to said housing means, said jarring means including:

a jar case; and jar mandrel means, connected to said housing means, for retaining said jar case in sliding relationship with said housing means.

3. An apparatus as defined in claim 1, wherein:

said support means includes:

a valve body having an opening forming a part of said second port defined therein and further having first stop means for defining a first limit of travel of said valve member;

retainer means, connected to said valve body, for retaining said biasing means in engagement with said valve member, said retainer means including second stop means for defining a second limit of travel of said valve member; and container means for holding said valve body and said retainer means; and said valve member is disposed in said container means so that said first port is positionable along said valve body between said opening and a position spaced from said opening and said valve member includes:

means for cooperating with said first stop means in response to said biasing means; and means for cooperating with said second stop means in response to said opposing force.

4. An apparatus for disposing, by means of movement of a cable, a sensor device in a pipe string of a well to measure a condition in the well, said apparatus comprising:

a valve case having a bottom end and a top end;

a housing case having a first end and a second end, said first end being connected to said top end of said valve case;

adapter means, connected to said second end, for coupling said apparatus with said pipe string;

a valve body having a first port, a second port, and a first shoulder defined therein, said valve body being disposed within said valve case;

a spring housing connected to said valve body adjacent said first shoulder and disposed within said housing case, said spring housing having a second shoulder;

a sliding sleeve valve having a third port, a third shoulder and a fourth shoulder, said sliding sleeve valve being slidably disposed adjacent said valve body so that said second and third ports are in fluid communication when said third shoulder engages said first shoulder and so that said first and third ports are in fluid communication when said fourth shoulder engages said second shoulder;

a spring, retained in said spring housing, for biasing, with a biasing force, said sliding sleeve valve toward a position wherein said third shoulder engages said first shoulder;

an inwardly protruding member associated with said sliding sleeve valve;

housing means for receiving said sensor device, said housing means having a fourth port defined therein for communicating said sensor device with said third port, and said housing means being longitudinally movable in said well with said cable; and connector means, mounted on said housing for cooperative engagement with said inwardly protruding member, for defining a first position and a second position to which said housing means is movable relative to said sliding sleeve valve, said first position being the lowermost position to which said housing means can move relative to said sliding sleeve valve wherein said fourth port is spaced from said third port, and said second position being the uppermost engaged position to which said housing means can move relative to said sliding sleeve valve wherein said third to fourth ports are substantially spatially aligned, said second position also being the position of said housing means from which movement of said sliding sleeve valve commences for placing said first, third and fourth ports in fluid communication with each other when a force greater than said biasing force is applied to said cable.

5. An apparatus as defined in claim 4, wherein said third and fourth ports are in fluid communication with each other when said housing means is in either said first position or said second position.

6. An apparatus as defined in claim 4, further comprising:

a jar case;

jar mandrel means for retaining said jar case in sliding relationship with said housing means; and coupling means for coupling said jar case with said cable.

7. An apparatus as defined in claim 6, wherein said third and fourth ports are in fluid communications with each other when said housing means is in either said first position or said second position.

8. A method of operating a wireline-connected housing having a first port which is to be brought into fluid communication with a second port of a sliding sleeve valve and a third port of a valve body, which sliding sleeve valve and said valve body are disposed in a pipe string in a well, and which sliding sleeve valve is biased by a biasing force to maintain said second and third ports in fluid-tight separation, said housing having a connector means associated therewith for locking with said sliding sleeve valve, said method comprising the steps of:

lowering said housing with said wireline into said well until said first port is below said second port;

lifting said housing with said wireline until said first port is substantially aligned with said second port and said connector means locks with said sliding sleeve valve; and tensioning said wireline with a force greater than said biasing force so that said housing and said engaged sliding sleeve valve are moved upward until said first, second and third ports are in fluid communication.

9. A method as defined in claim 8, further comprising, after said step of tensioning said wireline, the steps of:

lowering said housing with said wireline until said connector means unlocks from said sliding sleeve valve; and lifting said housing with said wireline out of said well.

10. A method of sensing a condition in a well, comprising the steps of:

disposing valve means in said well, said valve means including a valve body having a first port having well pressure therein, a second port in a valve member movable between a first position wherein said second port is fluid-tightly separated from said first port and a second position wherein said second port is in fluid communication with said first port, a biasing means for biasing said valve member toward said first position, and a lug associated with said valve member;

inserting into said well housing means having a condition sensor device retained therein, said housing means having a third port in fluid communication with said condition sensor device, and said housing means having associated therewith a connector means for cooperating with said lug, said connector means having two lug engagement limiting means for limiting the relative movement between said connector means and said lug;

lowering said housing means into said well until said lug engages a first one of said two lug engagement limiting means;

lifting said housing means until said lug engages a second one of said two lug engagement limiting means so that said third port is in fluid communication with said second port in said valve member at said first position; and continuing lifting said housing means until said biasing means is overcome and said valve member is moved to said second position so that said well pressure in said first port is communicated to said condition sensor device through said second and third ports.

11. A method as defined in claim 10, wherein:

said step of inserting into said well includes connecting to said housing means a cable of a hoist means for lowering and raising said cable into and out of said well; and each of said steps of lowering said housing means, lifting said housing means, and continuing lifting said housing means includes the step of actuating said hoist means to move said cable and said housing means connected thereto.

12. A method as defined in claim 11, wherein:

said connector means has a third lug engagement limiting means for limiting the relative movement between said connector means and said lug; and said method further comprises, after said step of continuing lifting, the steps of:

lowering said housing means until said lug engages said third lug engagement limiting means; and lifting said housing means out of said well.

13. A tool for sensing, with a sensor device, a condition in a well having a fluid, said tool comprising:

a slidable valve member having a first port defined therein;

biasing means for exerting a biasing force on said valve member;

support means for supporting said valve member and said biasing means, said support means including:

a second port for receiving said fluid from said well;

a valve body having an opening forming a part of said second port defined therein and further having first stop means for defining a first limit of travel of said valve member;

retainer means, connected to said valve body, for retaining said biasing means in engagement with said valve member, said retainer means including second stop means for defining a second limit of travel of said valve member; and container means for holding said valve body and said retainer means;

housing means having a cavity defined therein for receiving said sensor device and further having a third port defined therein in communication with said cavity; and connector means, disposed on said housing, for engaging and moving said valve member relative to said second port when said housing is disposed within said support means, said first and third ports are in fluid communication, and an opposing force greater than said biasing force is applied to said housing in opposition to said biasing force;

said valve member being disposed in said container means so that said first port is positionable along said valve body between said opening and a position spaced from said opening, said valve member further including:

means for cooperating with said first stop means in response to said biasing means; and means for cooperating with said second stop means in response to said opposing force.

14. An apparatus as defined in claim 13, wherein:

said apparatus further comprises a pin associated with said valve member; and said connector means includes a J-slot member, rotatably mounted on said housing means, having channel means for cooperating with said pin so that said valve member is moved between said first and second limits of travel in response to longitudinal movement of said housing means.

15. An apparatus as defined in claim 14, further comprising jarring means for providing a force impulse to said housing means, said jarring means including:

a jar case; and jar mandrel means, connected to said housing means, for retaining said jar case in sliding relationship with said housing means.

* * * * *